US012251070B2

(12) United States Patent
Hu et al.

(10) Patent No.: US 12,251,070 B2
(45) Date of Patent: Mar. 18, 2025

(54) METHODS OF MONITORING THE LOAD STATE OF A DISHWASHING APPLIANCE

(71) Applicant: Haier US Appliance Solutions, Inc., Wilmington, DE (US)

(72) Inventors: Haitian Hu, Louisville, KY (US); Adam Christopher Hofmann, Louisville, KY (US); Hairong Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 310 days.

(21) Appl. No.: 17/900,170

(22) Filed: Aug. 31, 2022

(65) Prior Publication Data

US 2024/0065521 A1 Feb. 29, 2024

(51) Int. Cl.
*A47L 15/42* (2006.01)
*A47L 15/00* (2006.01)

(52) U.S. Cl.
CPC ..... *A47L 15/4295* (2013.01); *A47L 15/0049* (2013.01); *A47L 15/006* (2013.01); *A47L 2401/04* (2013.01); *A47L 2401/26* (2013.01)

(58) Field of Classification Search
None
See application file for complete search history.

(56) References Cited

U.S. PATENT DOCUMENTS

| | | | |
|---|---|---|---|
| 5,839,458 | A | 11/1998 | Delcarson |
| 8,662,006 | B1 | 3/2014 | Patzer et al. |
| 10,017,894 | B2 | 7/2018 | Strahle |
| 11,017,217 | B2 | 5/2021 | Al Jazaery et al. |

FOREIGN PATENT DOCUMENTS

CN 112869679 A 7/2022

*Primary Examiner* — Rita P Adhlakha
(74) *Attorney, Agent, or Firm* — Dority & Manning, P.A.

(57) ABSTRACT

A method may include detecting one or more insertion actions for a loading one or more articles into the dishwashing appliance and directing, subsequent to the detected insertion actions, a dishwasher cycle within the dishwashing appliance. The method may also include detecting, subsequent to the dishwasher cycle, one or more removal actions for unloading the one or more articles from the dishwashing appliance. The method may further include evaluating the detected removal actions against the detected insertion actions and directing a user interface of the dishwashing appliance based on the evaluation.

12 Claims, 6 Drawing Sheets

METHODS OF MONITORING THE LOAD STATE OF A DISHWASHING APPLIANCE

FIELD OF THE INVENTION

The present subject matter relates generally to dishwashing appliances, and more particularly to methods to monitor the loading or unloading of a dishwashing appliance.

BACKGROUND OF THE INVENTION

Dishwashing appliances or dishwashers generally include a cabinet or tub that defines a wash chamber for receipt of articles for washing. A door mounted to the cabinet provides selective access to the washing chamber. The door is normally mounted to the cabinet using hinges that allow the door to rotate between an open configuration and a closed configuration. Certain dishwashing appliances also include a rack assembly slidably mounted within the wash chamber. A user can load articles, such as plates, bowls, glasses, or cups, into the rack assembly, and the rack assembly can support such articles within the wash chamber during operation of the dishwashing appliance. Spray assemblies within the wash chamber can apply or direct wash fluid towards articles disposed within the rack assemblies in order to clean such articles. Multiple spray assemblies can be provided, including, for example, a lower spray arm assembly mounted to the tub at a bottom of the wash chamber; a mid-level spray arm assembly mounted to one of the rack assemblies; or an upper spray assembly mounted to the tub at a top of the wash chamber. Other configurations may be used as well.

One of the common problems for users loading or unloading a dishwasher is keeping track of when articles within the dishwasher are clean or dirty. In typical appliances, a light or other visual indicator is provided to notify a user when a cycle is complete and, thus, that articles within the dishwasher are clean. Such indicators are usually deactivated when the door to the dishwasher is subsequently opened. Thus, as soon as the door is opened, a user may be unable to readily tell what the state (e.g., clean or dirty) is for articles within the dishwasher. If a user is not paying close attention, a dirty article may be inadvertently added to an otherwise clean load. This risks confusing the user and contaminating clean articles.

Recently, attempts have been made to incorporate cameras or sensors within dishwashing appliances to directly track which articles are dirty or clean inside of the dishwashing appliance or rack. Such configurations can expensive, difficult to assemble, or even negatively impact the reliability of a dishwasher. Often, such drawbacks prevent manufactures from even attempting to actively monitor the state of articles (e.g., after completion of a wash cycle and opening of the door).

As a result, it would be useful to provide a method or system for monitoring the state of articles inside a dishwasher. In particular, it may be advantageous to monitor articles without requiring dedicated sensors or cameras on a dishwashing appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwashing appliance is provided.

The method may include detecting one or more insertion actions for a loading one or more articles into the dishwashing appliance and directing, subsequent to the detected insertion actions, a dishwasher cycle within the dishwashing appliance. The method may also include detecting, subsequent to the dishwasher cycle, one or more removal actions for unloading the one or more articles from the dishwashing appliance. The method may further include evaluating the detected removal actions against the detected insertion actions and directing a user interface of the dishwashing appliance based on the evaluation.

In another exemplary aspect of the present disclosure, a method of operating a dishwashing appliance is provided. The method may include detecting, apart from the dishwashing appliance, one or more insertion actions for a loading one or more articles into the dishwashing appliance and directing, subsequent to the detected insertion actions, a dishwasher cycle within the dishwashing appliance. The method may also include detecting, apart from the dishwashing appliance and subsequent to the dishwasher cycle, one or more removal actions for unloading the one or more articles from the dishwashing appliance. The method may further include evaluating the detected removal actions against the detected insertion actions determining a load status of the dishwashing appliance based on the evaluation. The method may still further include directing a user interface of the dishwashing appliance based on the determined load status.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
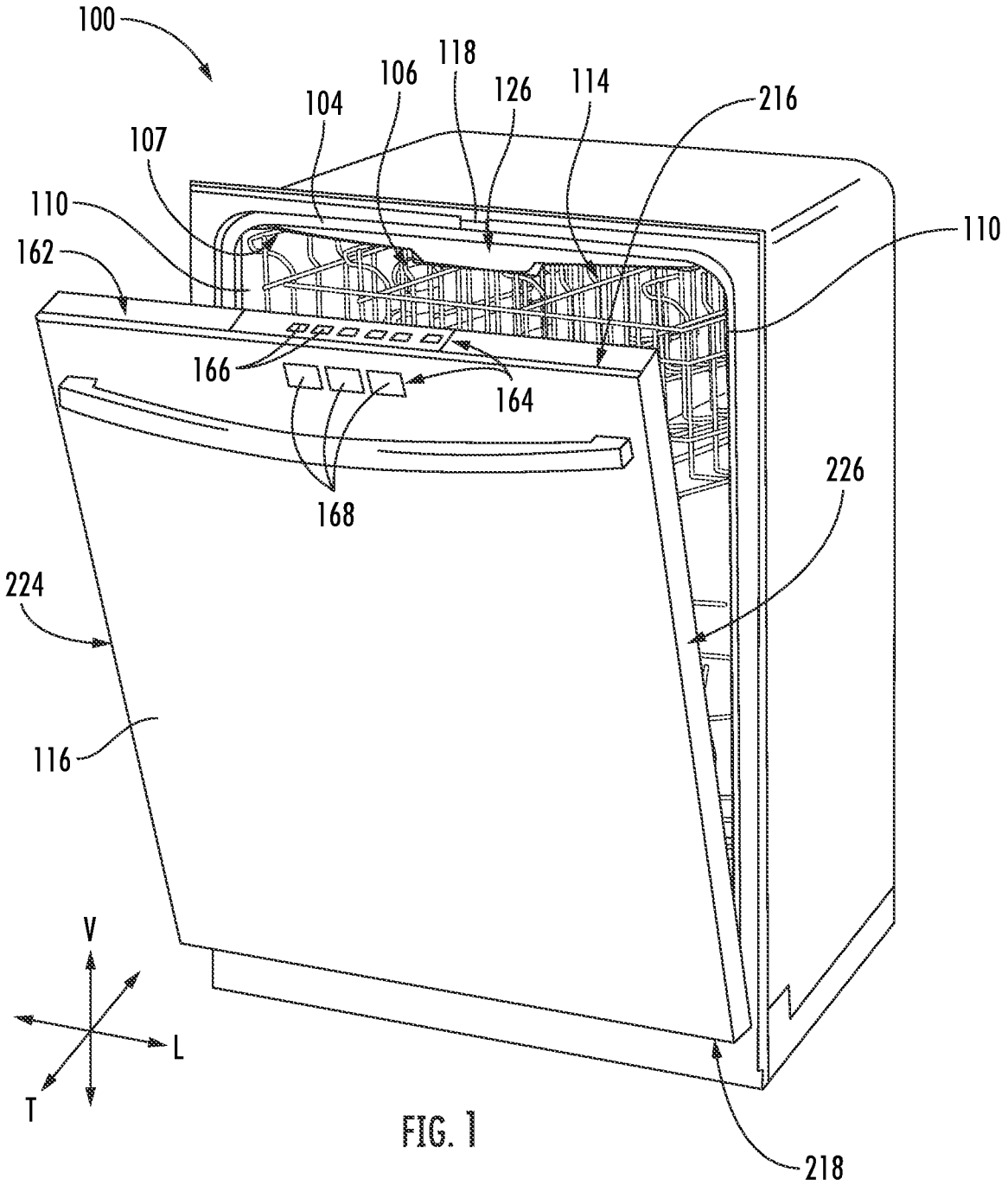
FIG. 1 provides a perspective view of a dishwasher appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
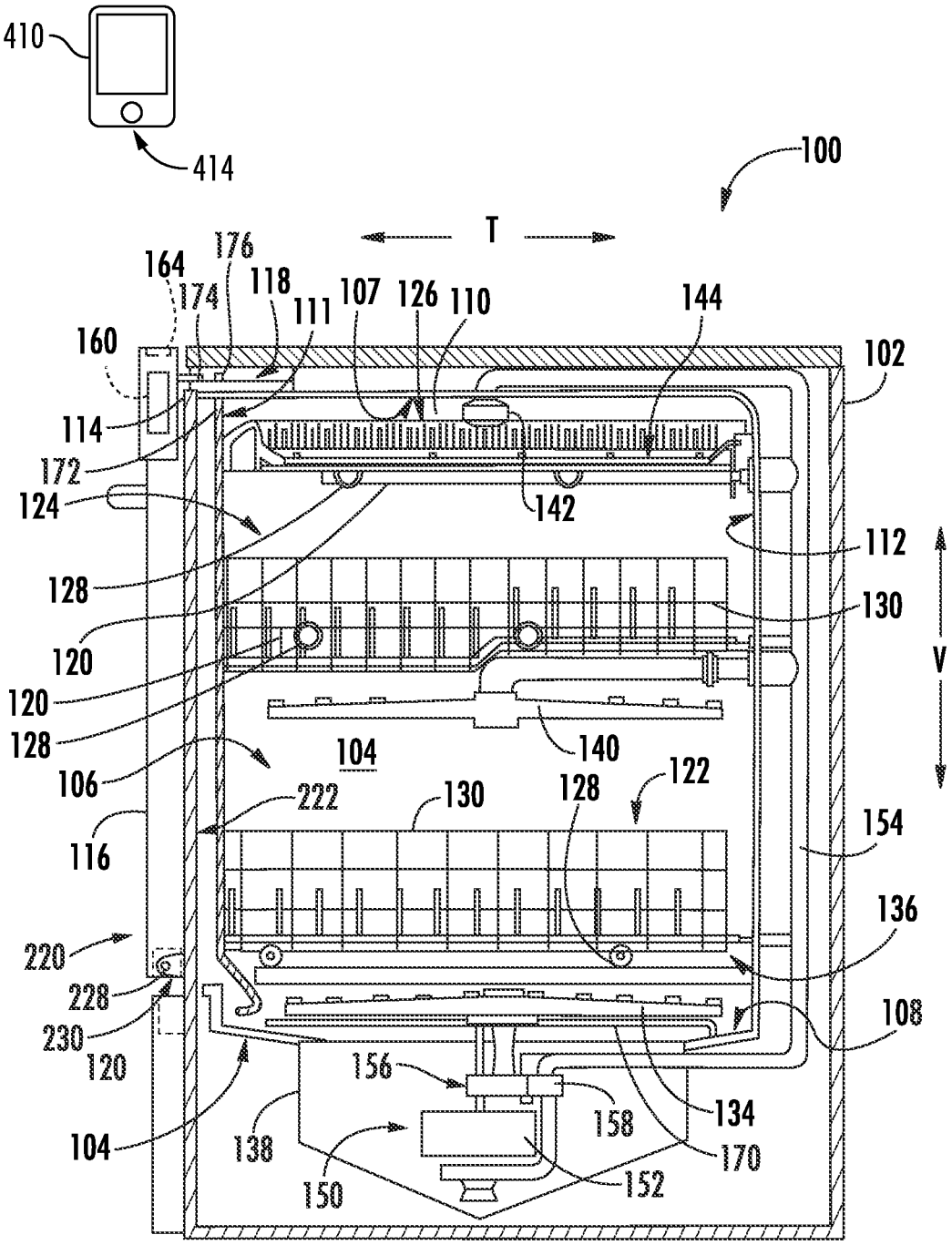
FIG. 2 provides a side cross-sectional view of the exemplary dishwashing appliance of FIG. 1.

Referring now to the figures,

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 that is generally configured for containing or supporting various components of appliance 100 and which may also define one or more internal chambers (e.g., wash chamber 106) or compartments of appliance 100. For instance, cabinet 102 may have or include a tub 104 that defines a wash chamber 106 therein. As used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, insulation material(s), or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

As shown, tub 104 extends between a top 107 and a bottom 108 along a vertical direction V, between a pair of sides or sidewalls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed (e.g., vertical) position (e.g., FIG. 2), wherein the wash chamber 106 is sealed shut for washing operation, and a one or more open positions (e.g., FIG. 1) for accessing, loading, or unloading of articles from the dishwasher 100. In the normally closed position, door 116 extends from a top end 216 to a bottom end 218 along the vertical direction V; from a front end 220 to a rear end 222 along the transverse direction T; and between two lateral edges or ends 224, 226 along the lateral direction L. A rotation axis 228 may be defined on the door 116 (e.g., by one or more lateral pivot hinges or pins), for example, parallel to the lateral direction L at or proximal to bottom end 218. According to exemplary embodiments, dishwasher 100 further includes a door closure mechanism or assembly 118 that is used to lock and unlock door 116 for accessing and sealing wash chamber 106.

As illustrated in FIG. 2, tub sidewalls 110 may accommodate a plurality of rack assemblies. For instance, guide rails 120 may be mounted to sidewalls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 may be fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a wash or rinse cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation (e.g., during or as part of a wash cycle, rinse cycle, or drain cycle), pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a dishwasher cycle (e.g., including one or more wash cycles, rinse cycles, drain cycles, etc.). The memory may represent random access memory such as DRAM, or read only memory such as ROM or FLASH. In some embodiments, the processor executes programming instructions stored in memory. For certain embodiments, the instructions include a software package configured to operate appliance 100, such as according to one or more programmed cycles methods (e.g., one or more portions of 500 or 600 described below). The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area of door 116, as shown in FIGS. 1 and 2. In such an embodiment, input/output ("I/O") signals may be routed between the control system and various operational components of dishwasher 100 along wiring harnesses that may be routed, for example, through the bottom of door 116.

Generally, controller 160 is in communication with one or more portions of a user interface through which a user may select various operational features and modes and monitor progress of the dishwasher 100. For instance, user interface may include or be provided as a control panel 164. In one embodiment, the control panel 164 may represent a general purpose I/O ("GPIO") device or functional block. In certain embodiments, the control panel 164 includes input components 166, such as one or more of a variety of electrical, mechanical or electro-mechanical input devices including rotary dials, push buttons, and touch pads (e.g., resistive or capacitive touch screen). As shown, one or more user inputs 166 (e.g., resistive or capacitive touch buttons) of control panel 164 may be positioned at a top end 216 of door 116 (e.g., on or through a top wall of door 116). The control panel 164 may further include one or more display components 168, such as a digital display device or one or more indicator light assemblies designed to provide operational feedback to a user. The control panel 164 may be in communication with the controller 160 via one or more signal lines or shared communication busses. In optional embodiments, the user interface includes or is provided as a remote user device 410, which may be in wireless communication with controller 160, as will be described below.

In some embodiments, a heating element 170 is operably coupled (e.g., electrically coupled) to the controller 160 to selectively provide heat to the wash chamber 106 (e.g., during a dry cycle). For example, heating element 170 may be provided as a resistive or sheathed heating element 170 (e.g., CALROD®) mounted to a bottom portion of tub 104. In some such embodiments, heating element 170 is attached to a bottom wall 108 within the sump 138 or wash chamber 106. Nonetheless, heating element 170 may include or be provided any suitable heater for heating wash chamber 106 (e.g., to dry articles therein), as is generally understood. During use, the controller 160 may thus transmit one or more heating signals (e.g., as an electrical current) in order to activate heating element 170 and initiate the generation of heat therefrom.

It should be appreciated that the present disclosure is not limited to any particular style, model, or configuration of dishwasher 100. The exemplary embodiment depicted in FIGS. 1 and 2 is for illustrative purposes only. For example, different locations may be provided for control panel 164, different configurations may be provided for rack assemblies 122, 124, 126, different spray arm assemblies 134, 140, 142 and spray manifold configurations may be used, and other differences may be applied while remaining within the scope of the present disclosure.

As noted above, a latch assembly 118 is included in some embodiments. Generally, latch assembly 118 may serve to selectively hold door 116 closed and may include a separate latch 174 (e.g., proximal to or mounted at a top portion of door 116) and catch 176 (e.g., disposed at or above top 107). As shown, latch 174 may generally extend rearward, such as from an inner or rearward-facing surface of door 116 and toward the cabinet 102. When closed or otherwise in the in the closed position (e.g., fully closed position—FIG. 2), latch 174 may be received within a cavity or catch 176 of cabinet 102 (e.g., such that latch is locked within cabinet 102).

In optional embodiments, door latch 118 includes a lock actuator or motor 172 to selectively move or motivate door 116, such as between the closed position and an open (e.g., partially open) position. For instance, lock motor 172 may be in selective mechanical communication with a latch 174 or another suitable portion of door 116 (e.g., proximal to a top portion thereof). Moreover, lock motor 172 may engage latch 174 such that lock motor 172 is able to motivate (e.g., push or pull) latch 174, and thus door 116, forward/rearward relative to a top portion of tub 104 or cabinet 102.

In some embodiments, latch assembly 118 is in operative (e.g., electrical or wireless) communication with controller 160. Controller 160 may be configured to detect door 116 in the closed position, such as through an include mechanical or electrical (e.g., magnetic) reed switch that transmits a closed door 116 signal (e.g., to controller 160) in response to engagement therewith by the door 116. In some such embodiments, closure assembly 118 includes a first contact mounted to tub 104 and a second contact mounted to door 116 (e.g., to rotate therewith). For instance, the first contact may provide a rail or catch (e.g., catch 176) that receives or contacts the second contact (e.g., latch 174) when door 116 is in the closed position or a partially open (e.g., vent) position.

Figure 3:
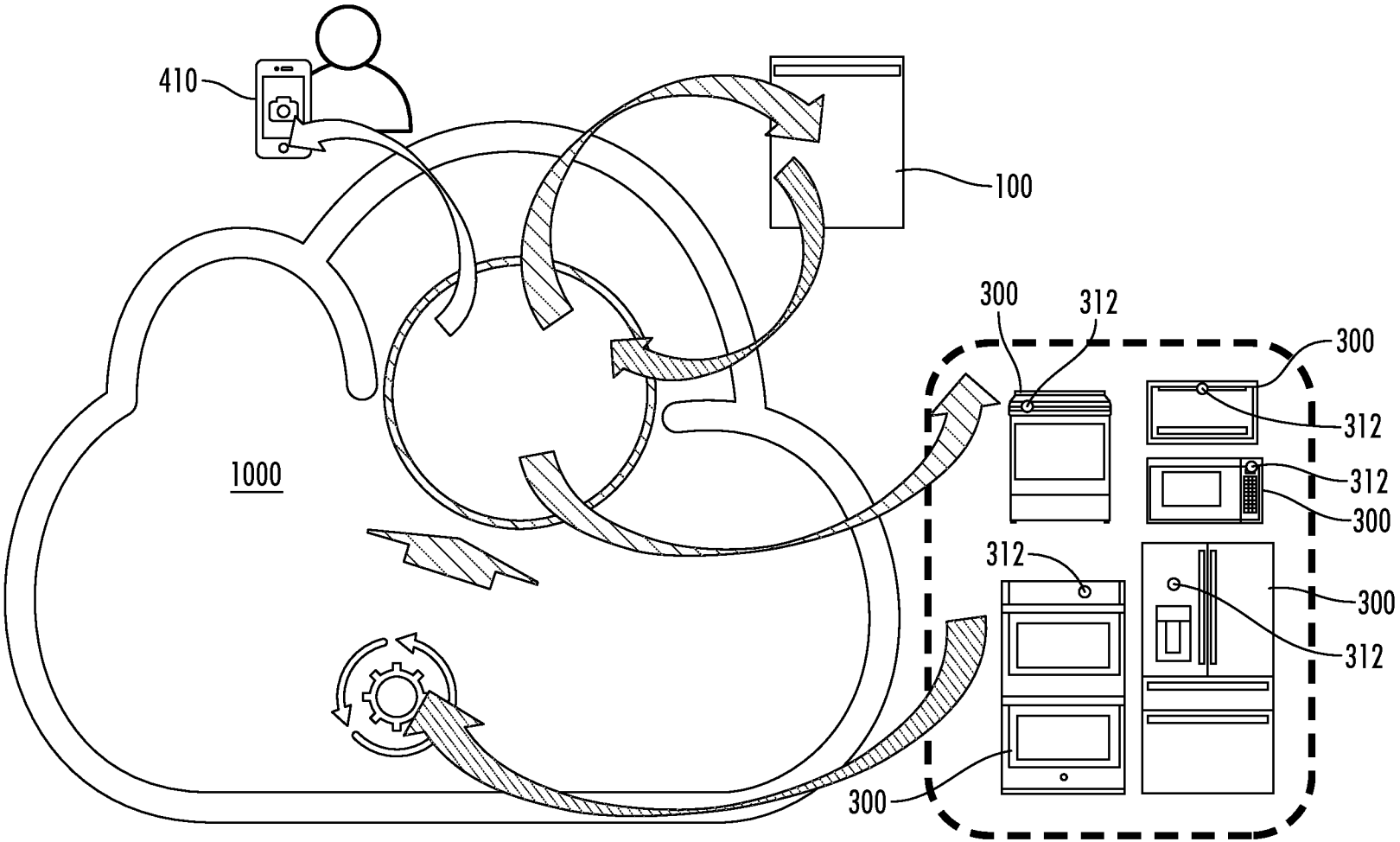
FIG. 3 provides a schematic view of a system for communicating between multiple domestic appliances according to exemplary embodiments of the present disclosure.
Figure 4:
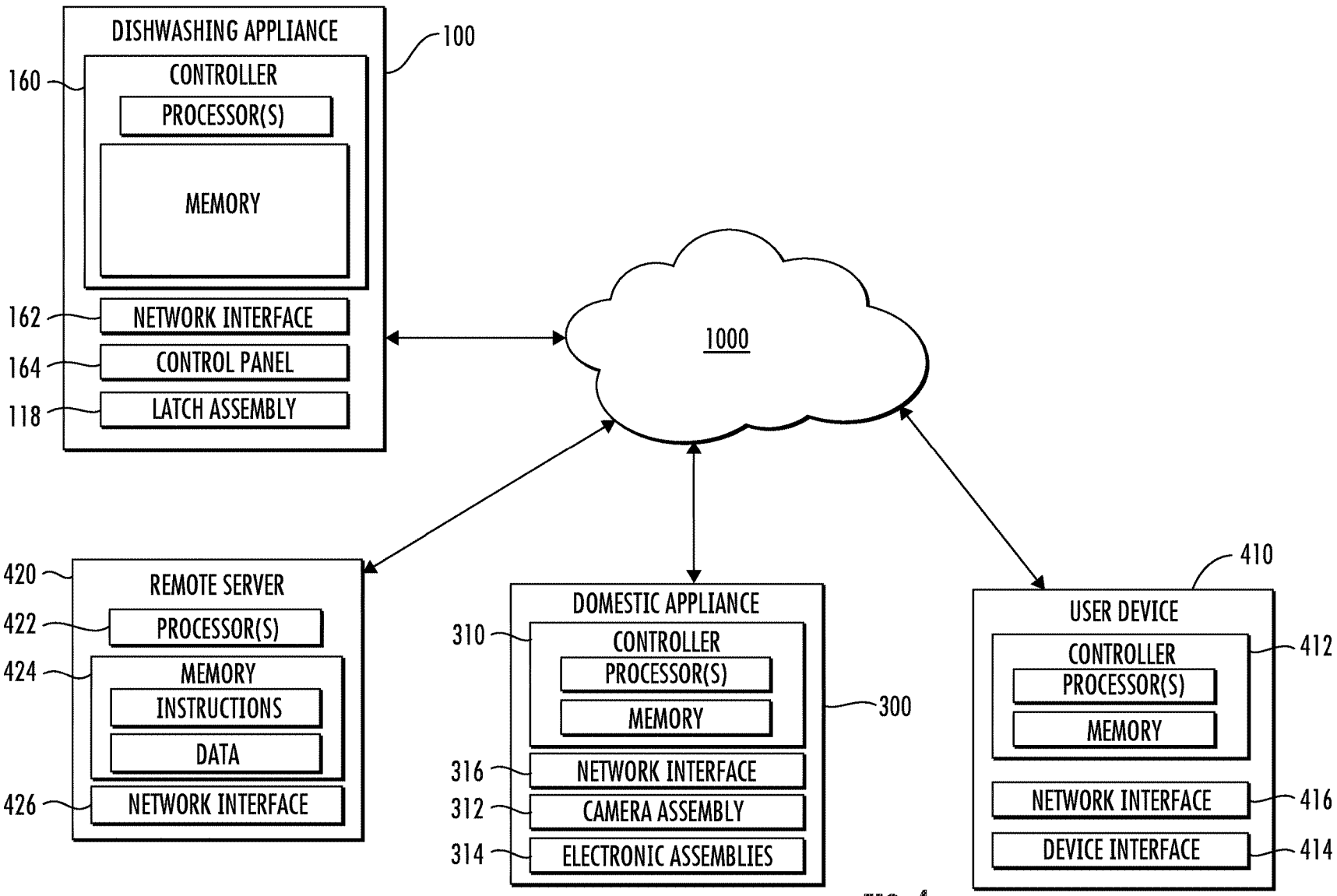
FIG. 4 provides a schematic view of a system for communicating between multiple domestic appliances according to exemplary embodiments of the present disclosure.

Turning now generally to FIGS. 3 and 4, dishwashing appliance 100 may be configured to communicate with one or more secondary appliances 300 or with one or more separate, external devices. For instance, controller 160 of dishwashing appliance 100 may be configured to communicate with another appliance 300, a remote user device 410, or remote server 420, either directly or via one or more intermediate devices or networks (e.g., network 1000).

In some embodiments, dishwashing appliance 100 may include a network interface 162 such that appliance 100 can connect to and communicate over one or more networks (e.g., network 1000) with one or more network nodes. Network interface 162 can be an onboard component of controller 160 or it can be a separate, off board component. Controller 160 can also include one or more transmitting, receiving, or transceiving components for transmitting/receiving communications with other devices communicatively coupled with appliance 100. Additionally or alternatively, one or more transmitting, receiving, or transceiving components can be located off board controller 160.

Generally, a secondary appliance 300 may be provided as any suitable domestic appliance that is spaced apart from dishwashing appliance 100. For instance, a secondary appliance 300 may include or be provided as a suitable range appliance, oven appliance, refrigerator appliance, microwave appliance (e.g., mounted above a range appliance), or interactive assembly (e.g., including a monitor or screen to be fixedly mounted within a home or kitchen), each of which is illustrated in FIG. 3 and would be generally understood. As would be further understood, though, a secondary appliance 300 may include or be provided as another domestic appliance that would commonly mounted in the same room as dishwashing appliance 100 (e.g., within a kitchen), such as a coffee maker, toaster oven, air fryer, etc.

Each secondary appliance 300 may include a controller 310 that is communicatively coupled to one or more camera assemblies 312 and electronic assemblies 314. Controller 310 may include one or more processors and one or more memory devices (i.e., memory). The one or more processors can be any suitable processing device (e.g., a processor core, a microprocessor, an ASIC, a FPGA, a microcontroller, etc.) and can be one processor or a plurality of processors that are operatively connected. The memory device A can include one or more non-transitory computer-readable storage mediums, such as RAM, ROM, EEPROM, EPROM, flash memory device, magnetic disks, etc., and combinations thereof. The memory devices can store data and instructions that are executed by the processor to cause the appliance 300 to perform operations. For example, instructions could be instructions for receiving/transmitting signals to/from the camera assembly 312 or activating the electronic assemblies 314. The memory devices may also include data, such as one or more detected parameters, audio signals, video signals, instruction panels, etc., that can be retrieved, manipulated, created, or stored by processor.

Controller 310 includes a network interface 316 such that appliance 300 can connect to and communicate over one or more networks (e.g., network 1000) with one or more network nodes. Network interface 316 can be an onboard component of controller 310 or it can be a separate, off board component. Controller 310 can also include one or more transmitting, receiving, or transceiving components for transmitting/receiving communications with other devices communicatively coupled with appliance 300. Additionally or alternatively, one or more transmitting, receiving, or transceiving components can be located off board controller 310.

Generally, secondary appliance 300 may include one or more electronic assemblies 312 (e.g., electrically controlled physical components), such as a pump, fan, monitor or display, heating element, sealed system, etc. Moreover, one or more camera assemblies 312 may be provided (e.g., mounted or fixed to the corresponding secondary appliance 300) to capture images (e.g., static images or dynamic video) of an area adjacent to or outward from the corresponding secondary appliance 300 (e.g., an area including or adjacent to dishwashing appliance 100 such that a user engaging with the appliance 100 may be captured). Each camera assembly 312 may be any type of device suitable for capturing a picture or video. As an example, each camera assembly 312 may be a video camera or a digital camera with an electronic image sensor [e.g., a charge coupled device (CCD) or a CMOS sensor]. A camera assembly 312 is generally provided in operable communication with controller 310 such that controller 310 may receive an image signal (e.g., video signal) from camera assembly 312 corresponding to the picture(s) captured by camera assembly 312. Once received by controller 310, the image signal (e.g., video signal) may be further processed at controller 310 or transmitted to a separate device (e.g., remote server 404 for further processing or analysis). In certain embodiments, one or more microphones (not pictured), such as a dynamic microphone, ribbon microphone, fiber-optic microphone, piezoelectric microphone, etc., may be provided (e.g., on a cabinet of secondary appliance 100) to capture and transmit audio signal(s). Optionally, a microphone may be associated with the camera assembly 312 to capture and transmit audio signal(s) coinciding (or otherwise corresponding) with the captured image signal or picture(s).

In some embodiments, a camera assembly 312 is directed away from the corresponding secondary appliance 300 on which camera assembly 312 is mounted. In other words, camera assembly 312 may be oriented to capture light emitted or reflected from an area outside of secondary appliance 300. For instance, camera assembly 312 may be directed at the area that includes or is adjacent to dishwashing appliance 100 (e.g., forward from the secondary appliance 300). Thus, camera assembly 312 may selectively capture an image of the area including dishwashing appliance 100 or directly above or beside appliance 100. This area may correspond to or cover the location where a user would typically stand during use of dishwashing appliance 100 (e.g., loading, unloading, contacting control panel 164, opening door 116, etc.). During use, at least a portion of a user's body may be captured by camera assembly 312 while the user is standing in front or beside of dishwashing appliance 100.

Network 1000 can be any suitable type of network, such as a local area network (e.g., intranet), wide area network (e.g., internet), low power wireless networks [e.g., Bluetooth Low Energy (BLE)], or some combination thereof and can include any number of wired or wireless links. In general, communication over network 1000 can be carried via any type of wired or wireless connection, using a wide variety of communication protocols (e.g., TCP/IP, HTTP, SMTP, FTP), encodings or formats (e.g., HTML, XML), or protection schemes (e.g., VPN, secure HTTP, SSL).

The remote user device 410 may be a laptop computer, smartphone, tablet, personal computer, wearable device, smart home system, or various other suitable devices including a device controller 412 and device interface 414 (e.g., buttons or touchscreen display). Generally, the remote user device 410 includes a device controller 412 having a memory (e.g., non-transitive storage media) for storing and retrieving programming instructions. For example, the remote user device 410 may be a smartphone operable to store and run applications (i.e., "apps") and may include a remote user interface provided as a smartphone app. Device controller 412 may include a network interface 416 such that remote user device 410 can connect to and communicate over one or more networks (e.g., network 1000) with one or more network nodes. Network interface 416 can be an onboard component of device controller 412 or it can be a separate, off board component. Device controller 412 can also include one or more transmitting, receiving, or transceiving components for transmitting/receiving communications with other devices communicatively coupled with remote user device 410. Additionally or alternatively, one or more transmitting, receiving, or transceiving components can be located off board controller 412.

In some embodiments, a remote server 420, such as a web server, is in operable communication with one or more appliances 100, 300 or remote devices 410. The server 420 can be used to host an engagement platform (e.g., for sharing or analyzing images between appliances 100, 300 associated with the same user account). Additionally or alternatively, the server 420 can be used to host an information database (e.g., for storing user data or images). The server 420 can be implemented using any suitable computing device(s). The server 420 may include one or more processors 422 and one or more memory devices 424 (i.e., memory). The one or more processors 422 can be any suitable processing device (e.g., a processor core, a microprocessor, an ASIC, a FPGA, a microcontroller, etc.) and can be one processor or a plurality of processors that are operatively connected. The memory device 424 can include one or more non-transitory computer-readable storage mediums, such as RAM, ROM, EEPROM, EPROM, flash memory devices, magnetic disks, etc., and combinations thereof. The memory devices 424 can store data and instructions which are executed by the processor 422 to cause remote server 420 to perform operations. For example, instructions could be instructions for receiving, transmitting, analyzing, or organizing images between one or more appliances 100, 300.

The memory devices 424 may also include data that can be retrieved, manipulated, created, or stored by processor 422. The data can be stored in one or more databases. The one or more databases can be connected to remote server 420 by a high bandwidth LAN or WAN, or can also be connected to remote server 420 through network 1000. The one or more databases can be split up so that they are located in multiple locales.

Remote server 420 includes a network interface 426 such that interactive remote server 420 can connect to and communicate over one or more networks (e.g., network 1000) with one or more network nodes. Network interface 426 can be an onboard component or it can be a separate, off board component. In turn, remote server 420 can exchange data with one or more nodes over the network 1000. As an example, remote server 420 can exchange data with one or more appliances 300 or user devices 410.

Generally, it is understood that remote server 420 may further exchange data with any number of client devices over the network 1000. The client devices can be any suitable type of computing device, such as a general-purpose computer, special purpose computer, laptop, desktop, integrated circuit, mobile device, smartphone, tablet, or other suitable computing device. In some embodiments, data, including image signals from camera assembly 312, may thus be exchanged received, shared or analyzed (e.g., between appliances 100, 300). Remote server 420 (e.g., the processor(s) and memory device(s) thereof) can be configured to perform a variety of computer-implemented functions or instructions (e.g. performing the methods, steps, calculations, etc. and storing relevant data, as disclosed herein). It should be noted that remote server 420, as disclosed herein is capable of, and may be operable to perform, any methods and associated method steps as disclosed herein.

During use, appliances 300 may be in communication with the separate external device 410 or 420 through various possible communication connections and channels, such as but not limited to wireless radio frequency (RF) channels (e.g., ZIGBEE®, BLUETOOTH®, WI-FI®, etc.) or any other suitable communication connection.

Figure 5:
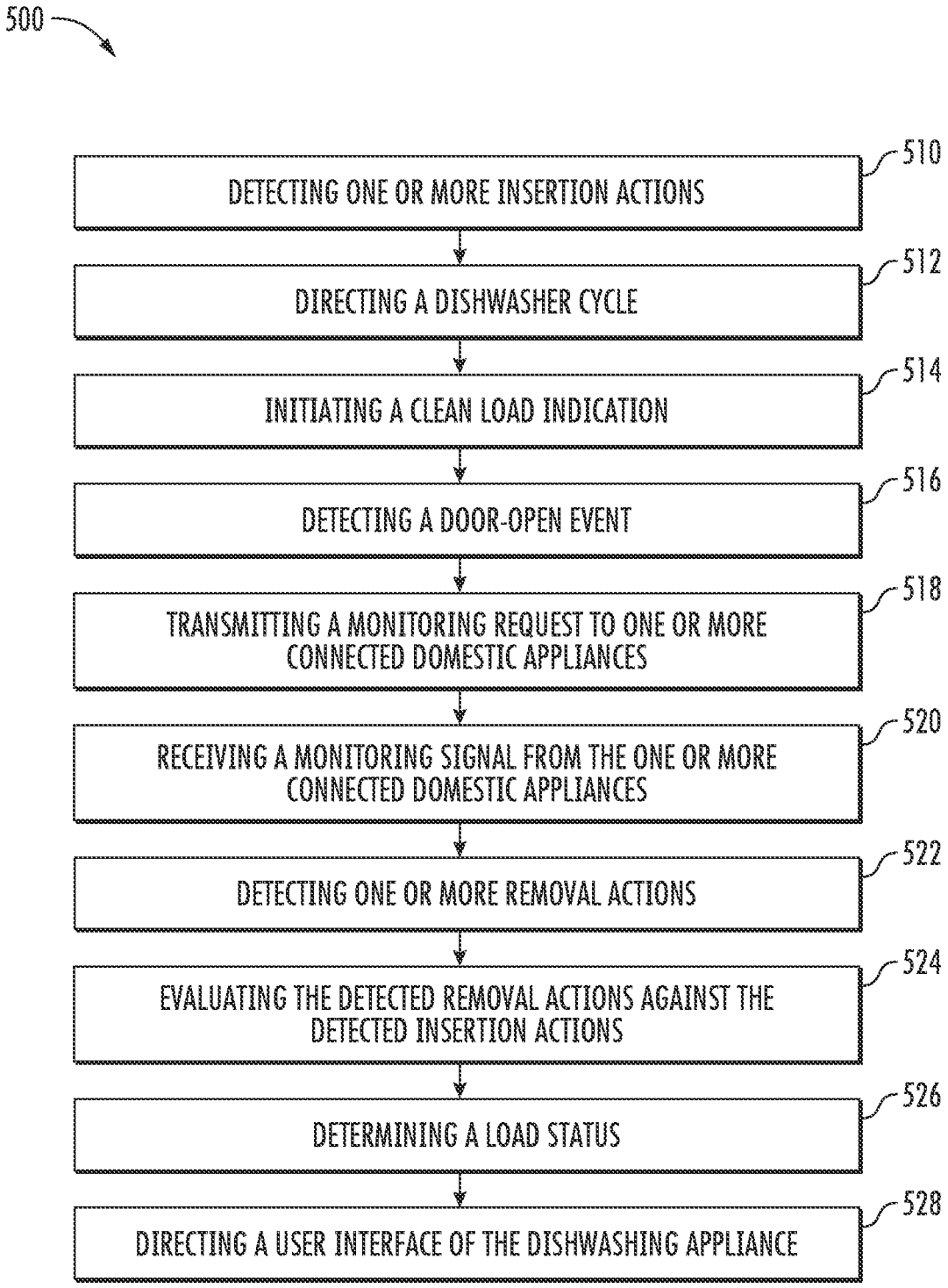
FIG. 5 provides a flow chart illustrating a method of operating a dishwashing appliance according to exemplary embodiments of the present disclosure.
Figure 6:
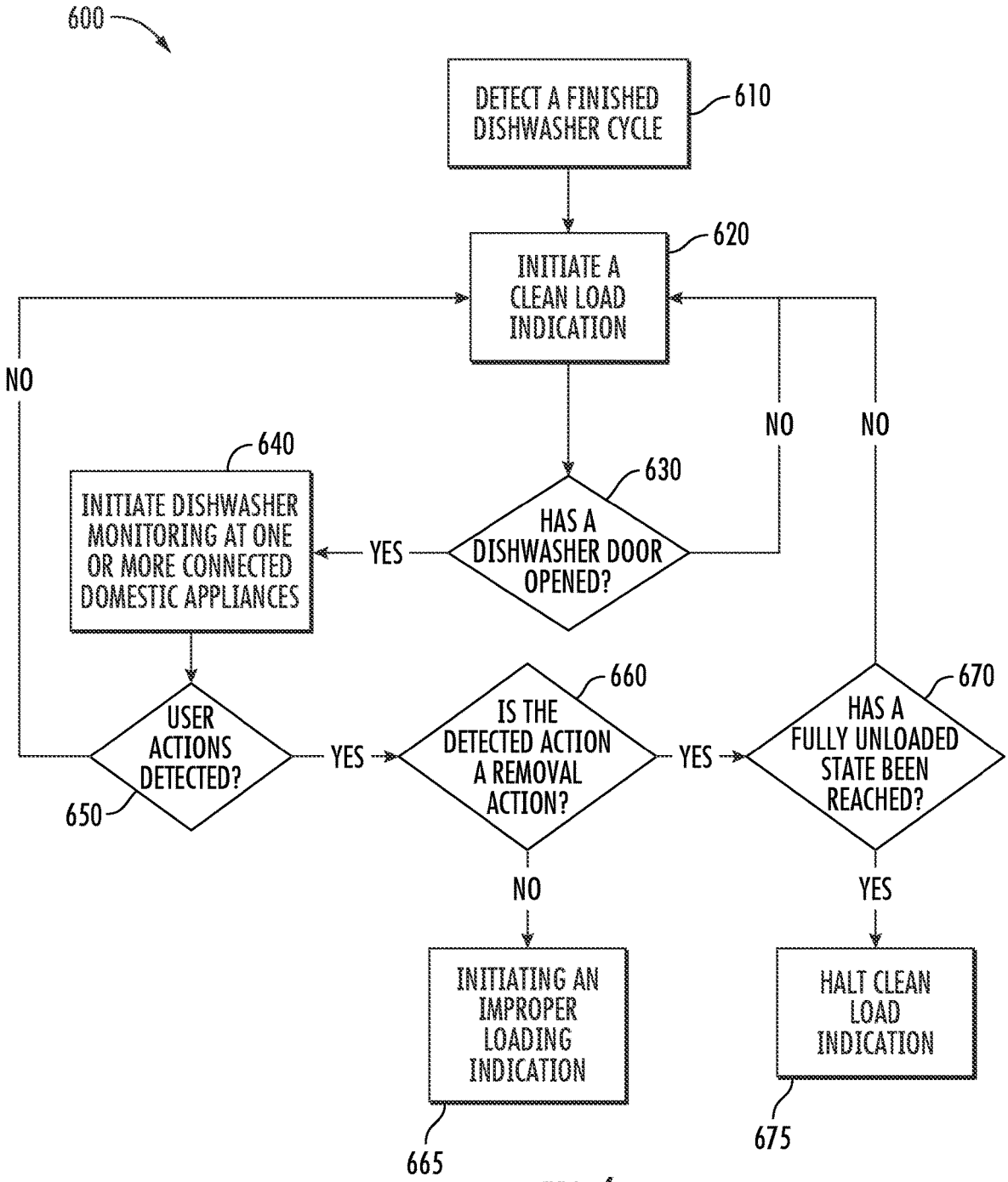
FIG. 6 provides a flow chart illustrating a method of operating a dishwashing appliance according to exemplary embodiments of the present disclosure.

Turning now to FIGS. 5 and 6, flow charts are provided of methods (e.g., 500 and 600) according to exemplary embodiments of the present disclosure. Generally, the methods 500 and 600 provide methods of operating a dishwashing appliance 100 (FIG. 1), as described above. As further described above, the dishwashing appliance 100 may be in communication (e.g., wireless communication) with one or more secondary domestic appliances 300. The method 500 or 600 can be performed, at least in part, by the controller 160, controller 310, or remote server 420. For example, controller 160 may, as discussed, be in communication with camera 312 (e.g., via network 1000 or remote server 420). During operations, controller 160 may send signals to and receive signals from camera 312 or remote server 420. Controller 160 may further be in communication with other suitable components of the appliance 100 to facilitate operation of the appliance 100 generally.

Advantageously, methods in accordance with the present disclosure may efficiently monitor the state of articles inside a dishwasher. Additionally or alternatively, the present methods may facilitate monitoring articles without requiring dedicated sensors or cameras on a dishwashing appliance. Further additionally or alternatively, the present methods may provide for improved data handling (e.g., in which images are captured and processed apart from a dishwashing appliance 100, such as on a secondary appliance 300 and remote server 420, respectively) for monitoring a load state of a dishwashing appliance 100.

FIGS. 5 and 6 depicts steps performed in a particular order for purpose of illustration and discussion. Those of ordinary skill in the art, using the disclosures provided herein, will understand that the methods are not mutually exclusive and the steps of any of the methods disclosed herein can be modified, adapted, rearranged, omitted, or expanded in various ways without deviating from the scope of the present disclosure (except as otherwise described or required).

Turning especially to FIG. 5, at 510, the method 500 includes detecting one or more insertion actions for a loading one or more articles into the dishwashing appliance. Such detections may be made apart from the dishwashing appliance itself (e.g., based on signals or images received from one or more secondary domestic appliances). In some embodiments, 510 includes receiving a captured image from a camera assembly in operable communication with the dishwashing appliance. As noted above a camera assembly may be fixed to a domestic secondary appliance spaced apart from the dishwashing appliance (e.g., directed at or adjacent to the dishwashing appliance to capture images of a user's interactions with the dishwashing appliance). Such a camera assembly may be prompted or directed to capture one or more images as part of an image capture sequence.

The image capture sequence may be initiated, for instance, in response to a monitoring request (e.g., transmitted from the dishwashing appliance). Such a monitoring request may be initiated by a triggering event (e.g., detected opening or closing of the door to the dishwashing appliance at the latch assembly). Additionally or alternatively, the image capture sequence may be initiated based on a set capture condition (e.g., programmed on the controller of the corresponding domestic appliance). Such a set capture condition may include a predetermined time interval (e.g., capturing images continuously according to the time interval), detected motion (e.g., capturing images in response to recognized motion within the line of sight of the camera assembly, as would be understood), or any other suitable condition to detect a user's presence or movement in front of the camera assembly. During the image capture sequence, an image may be captured that includes a user (e.g., interacting with the dishwashing appliance or otherwise within the line of sight of the camera assembly). The image may then be included with an image signal received that may be transmitted from the camera assembly (e.g., for further analysis at the secondary appliance controller, remote server, etc.).

In some embodiments, one or more of the captured images at 510 may be analyzed to detect a user or discern what kind of interaction is occurring at the dishwashing appliance. Specifically, the image analysis may detect or identify one or more insertion actions (e.g., across multiple images) in which a user inserts or loads an article into the wash chamber or rack assembly. Such an insertion action may be distinguished, for instance, by a discrete instance of a user bending over, extending an arm, or depositing an article within the wash chamber or rack assembly (e.g., as visible in one or more captured images). If multiple insertion actions are detected, an insertion count may be calculated (e.g., as a number of total insertion actions detected).

According to exemplary embodiments, the image analysis at 510 may use any suitable image processing technique, image recognition process, etc. As used herein, the terms "image analysis" and the like may be used generally to refer to any suitable method of observation, analysis, image decomposition, feature extraction, image classification, etc. of one or more images, videos, or other visual representations of an object. As explained in more detail below, this image analysis may include the implementation of image processing techniques, image recognition techniques, or any suitable combination thereof. In this regard, the image analysis may use any suitable image analysis software or algorithm to constantly or periodically monitor the cooking utensil. It should be appreciated that this image analysis or processing may be performed locally (e.g., by the appliance controller) or remotely (e.g., by offloading image data to the remote server or network).

Specifically, the analysis of the one or more images may include implementation an image processing algorithm. As used herein, the terms "image processing" and the like are generally intended to refer to any suitable methods or algorithms for analyzing images that do not rely on artificial intelligence or machine learning techniques (e.g., in contrast to the machine learning image recognition processes described below). For example, the image processing algorithm may rely on image differentiation, e.g., such as a pixel-by-pixel comparison of two sequential images. This comparison may help identify substantial differences between the sequentially obtained images, e.g., to identify movement, the presence of a particular object, the existence of a certain condition, etc. For example, one or more reference images may be obtained when a particular condition exists, and these references images may be stored for future comparison with images obtained during appliance operation. Similarities or differences between the reference image and the obtained image may be used to extract useful information for improving appliance performance.

According to exemplary embodiments, image processing may include blur detection algorithms that are generally intended to compute, measure, or otherwise determine the amount of blur in an image. For example, these blur detection algorithms may rely on focus measure operators, the Fast Fourier Transform along with examination of the frequency distributions, determining the variance of a Laplacian operator, or any other methods of blur detection known by those having ordinary skill in the art. In addition, or alternatively, the image processing algorithms may use other suitable techniques for recognizing or identifying items or objects, such as edge matching or detection, divide-and-conquer searching, greyscale matching, histograms of receptive field responses, or another suitable routine (e.g., executed at the appliance controller based on one or more captured images from one or more cameras). Other image processing techniques are possible and within the scope of the present subject matter. The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image.

In addition to the image processing techniques described above, the image analysis may include utilizing artificial intelligence ("AI"), such as a machine learning image recognition process, a neural network classification module, any other suitable artificial intelligence (AI) technique, or any other suitable image analysis techniques, examples of which will be described in more detail below. Moreover, each of the exemplary image analysis or evaluation processes described below may be used independently, collectively, or interchangeably to extract detailed information regarding the images being analyzed to facilitate performance of one or more methods described herein or to otherwise improve appliance operation. According to exemplary embodiments, any suitable number and combination of image processing, image recognition, or other image analysis techniques may be used to obtain an accurate analysis of the obtained (i.e., captured) images according to a trained AI model.

In this regard, the image recognition process may use any suitable artificial intelligence technique, for example, any suitable machine learning technique, or for example, any suitable deep learning technique. According to an exemplary embodiment, the image recognition process may include the implementation of a form of image recognition called region based convolutional neural network ("R-CNN") image recognition. Generally speaking, R-CNN may include taking an input image and extracting region proposals that include a potential object or region of an image. In this regard, a "region proposal" may be one or more regions in an image that could belong to a particular object or may include adjacent regions that share common pixel characteristics. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like, as opposed to a regular R-CNN architecture. For example, mask R-CNN may be based on fast R-CNN which is slightly different than R-CNN. For example, R-CNN first applies a convolutional neural network ("CNN") and then allocates it to zone recommendations on the covn5 property map instead of the initially split into zone recommendations. In addition, according to exemplary embodiments, standard CNN may be used to obtain, identify, or detect any other qualitative or quantitative data related to one or more objects or regions within the one or more images. In addition, a K-means algorithm may be used.

According to still other embodiments, the image recognition process may use any other suitable neural network process while remaining within the scope of the present subject matter. For example, the step of analyzing the one or more images may include using a deep belief network ("DBN") image recognition process. A DBN image recognition process may generally include stacking many individual unsupervised networks that use each network's hidden layer as the input for the next layer. According to still other embodiments, the step of analyzing one or more images may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence analysis techniques, and combinations of the above described or other known methods may be used while remaining within the scope of the present subject matter.

In addition, it should be appreciated that various transfer techniques may be used but use of such techniques is not required. If using transfer techniques learning, a neural network architecture may be pretrained such as VGG16/VGG19/ResNet50 with a public dataset then the last layer may be retrained with an appliance specific dataset. In addition, or alternatively, the image recognition process may include detection of certain conditions based on comparison of initial conditions, may rely on image subtraction techniques, image stacking techniques, image concatenation, etc. For example, the subtracted image may be used to train a neural network with multiple classes for future comparison and image classification.

It should be appreciated that the machine learning image recognition models may be actively trained by the appliance with new images, may be supplied with training data from the manufacturer or from another remote source, or may be trained in any other suitable manner. For example, according to exemplary embodiments, this image recognition process relies at least in part on a neural network trained with a plurality of images of the appliance in different configurations, experiencing different conditions, or being interacted with in different manners. This training data may be stored locally or remotely and may be communicated to a remote server for training other appliances and models.

It should be appreciated that image processing and machine learning image recognition processes may be used together to facilitate improved image analysis, object detection, or to extract other useful qualitative or quantitative data or information from the one or more images that may be used to improve the operation or performance of the appliance. Indeed, the methods described herein may use any or all of these techniques interchangeably to improve image analysis process and facilitate improved appliance performance and consumer satisfaction. The image processing algorithms and machine learning image recognition processes described herein are only exemplary and are not intended to limit the scope of the present subject matter in any manner.

At 512, the method 500 includes directing a dishwasher cycle subsequent to 510. In other words, after one or more articles are loaded into the dishwashing appliance, a dishwasher cycle (e.g., including one or more wash cycles, rinse cycles, drain cycles, etc.) may be performed upon the articles to clean the load within the dishwashing appliance (e.g., as instructed by a user selecting—directly or indirectly—the dishwasher cycle). Generally, such dishwasher cycles are known in the art and may be performed accordingly.

At 514, the method 500 includes initiating a clean load indication at the user interface (e.g., control panel or remote device) after (i.e., subsequent to) completion of the dishwasher cycle at 512. The clean load indication may include, for instance, an illuminated icon, projection, image, or displayed text on the door or control panel of the dishwashing appliance. Additionally or alternatively, the clean load indication may include an image or displayed text on the remote device, or any other suitable arrangement for visually notifying a user that the dishwasher cycle is complete (i.e., articles within the appliance may be considered "clean").

At 516, the method 500 includes detecting a door-open event. The door-open event may generally indicate that the door to the dishwashing appliance has been opened or moved to an open position following completion of the dishwasher cycle at 512. For instance, a signal may be received from the latch assembly, as described above. Additionally or alternatively, one or more signals may be received from another separate sensor (e.g., accelerometer, gyroscope, Hall effect sensor, etc.) mounted to or associated with the dishwasher door to detect positioning or movement of the dishwasher door away from the closed position, as would be understood.

At 518, the method 500 includes transmitting a monitoring request to one or more connected domestic appliances. Generally, 518 follows 514 or 516. In some embodiments, transmission of the monitoring request is based on or prompted by the detected door-open event. Thus, opening the door of the dishwashing appliance may cause the monitoring request to be transmitted to the secondary domestic appliance(s) connected to the dishwashing appliance.

At 520, the method 500 includes receiving a monitoring signal from the one or more connected domestic appliances. Specifically, 520 may follow an initiated monitoring or image capture sequence prompted at the domestic appliance(s) by 518. Thus, 520 may be in response to 518. For instance, once the monitoring request is received by the connected domestic appliance(s), each domestic appliance may be directed to capture or transmit images (e.g., for a set period of time as part of a new image capture sequence) to the remote server or dishwashing appliance. The subsequently captured images may be transmitted as or as part of the monitoring signal.

At 522, the method 500 includes detecting one or more removal actions. Generally, the removal actions are detected apart from the dishwashing appliance itself (e.g., based on monitoring signal or images received from one or more of the connected secondary domestic appliances). Moreover, the removal actions are detected subsequent to 512 and may be at least partially conditioned on 516. For instance, 522 may be based on the received monitoring signal (e.g., image analysis of the received images at 520). If multiple removal actions are detected, a removal count may be calculated (e.g., as a number of total removal actions detected).

In some embodiments, at 522, one or more of the captured images from 520 may be analyzed to detect a user or discern what kind of interaction is occurring at the dishwashing appliance. Specifically, the image analysis may detect or identify one or more removal actions (e.g., across multiple images) in which a user inserts or loads an article into the wash chamber or rack assembly. Such a removal action may be distinguished, for instance, by a discrete instance of a user bending over, extending an arm, or depositing an article within the wash chamber or rack assembly (e.g., as visible in one or more captured images).

According to exemplary embodiments, the image analysis at 522 may use any suitable image processing technique, image recognition process, etc. (e.g., as described above), including use of a suitable trained AI model (e.g., which is capable of distinguishing between a discrete insertion action and removal action in one or more captured images).

At 524, the method 500 includes evaluating the detected removal actions against the detected insertion actions. Specifically, the detected removal actions may be compared to the detected insertion actions. For instance, 524 may include comparing the removal count to the insertion count. Optionally, a predetermined matching condition based on the detected insertion actions may be provided for the evaluation (e.g., to determine if the detected removal actions match the detected insertion actions). In some embodiments, the matching condition includes set range (e.g., number range, function, or percentage calculated based on the detected insertion actions or insertion count) for deviations between the detected removal actions (e.g., the removal count) and the detected insertion actions (e.g., the insertion count). In other words, it may be determined whether the total number of removal actions is within the set range from the total number of insertion actions. Optionally, the set range may be less than or equal to 10% of the insertion count. Thus, in order to match, the removal count may be required to be within 10% of the insertion count. Based on the conditions of a particular execution of 500, 524 may include determining the detected removal actions meet the predetermined matching condition or, alternatively, determining fails the detected removal actions fail the predetermined matching condition.

At 526, the method 500 includes determining a load status based on the evaluation at 524. For instance, 526 may include a determination as to whether the dishwashing appliance is fully unloaded (e.g., such that all articles have been removed from the dishwashing appliance) or at least partially loaded (e.g., such that one or more articles remain within the wash chamber or rack assemblies). As an example, an evaluation in which determining the detected removal actions meets the predetermined matching condition may indicate or prompt a determination that the load status is fully unloaded. As another example, an evaluation in which determining the detected removal actions fails the predetermined matching condition may indicate or prompt a determination that the load status is at least partially loaded (i.e., not fully unloaded).

At 528, the method 500 includes directing a user interface of the dishwashing appliance (e.g., at the control panel or remote device) based on the evaluation or determined load status. In response to a fully unloaded status being met or the detected removal actions otherwise meeting the predetermined matching condition, 528 may include halting the clean load indication (e.g., such that a user can be confident that any subsequently inserted articles are not clean). In response to a loaded (e.g., at least partially loaded or not fully unloaded) state or the detected removal actions otherwise failing the predetermined matching condition, 528 may include maintaining the clean load indication.

In optional embodiments, during a loaded (e.g., at least partially loaded) state, a user may attempt to insert an item. For instance, a new insertion action may be detected subsequent to determining the detected removal actions fails the predetermined matching condition and without determining a fully unloaded state. Such a determination may be similar to that of 510, but be based on a new signal [e.g., newly captured image(s)]. Optionally, a new image capture sequence may be initiated (e.g., in response to door movement following 522) or the new insertion action may be detected from images captured in the same image capture sequence of 522. In response to detecting the new insertion action, 528 may include initiating an improper loading indication at the user interface. The improper loading indication may include, for instance, an illuminated icon (e.g., rapid sequence), projection, image, or displayed text on the door or control panel of the dishwashing appliance. Additionally or alternatively, an audible notification may be generated at a speaker of the control panel. Further additionally or alternatively, the clean load indication may include an image or displayed text on the remote device, or any other suitable arrangement for visually or audibly notifying a user that articles have been improperly loaded into the dishwasher (e.g., a "dirty" article has been mixed with articles within the appliance that may be considered "clean").

Turning now to FIG. 6, at 610, the method 600 includes detecting a finished dishwasher cycle. In other words, after one or more articles are loaded into the dishwashing appliance, a dishwasher cycle (e.g., including one or more wash cycles, rinse cycles, drain cycles, etc.) may be performed upon the articles to clean the load within the dishwashing appliance (e.g., as instructed by a user selecting—directly or indirectly—the dishwasher cycle). Generally, such dishwasher cycles are known in the art and may be performed accordingly. Moreover, detecting completion of the same is generally known.

At 620, the method 600 includes initiating a clean load indication. The clean load indication may be generated at the user interface (e.g., control panel or remote device) after (e.g., in response to) detected completion of the dishwasher cycle at 610. The clean load indication may include, for instance, an illuminated icon, projection, image, or displayed text on the door or control panel of the dishwashing appliance. Additionally or alternatively, the clean load indication may include an image or displayed text on the remote device, or any other suitable arrangement for visually notifying a user that the dishwasher cycle is complete (i.e., articles within the appliance may be considered "clean").

At 630, the method 600 includes evaluating the door status. In particular, the door may be determined if the door has been opened following 610. For instance, a signal may be received from the latch assembly, as described above. Additionally or alternatively, one or more signals may be received from another separate sensor (e.g., accelerometer, gyroscope, etc.) mounted to or associated with the dishwasher door to detect positioning or movement of the dishwasher door away from the closed position, as would be understood. If the door has not been opened, the method 600 may return to 620 (e.g., to maintain the clean load indication). By contrast, if the door has been opened (e.g., an open-door event is detected), the method 600 may proceed to 640.

At 640, the method 600 includes initiating dishwasher monitoring at one or more connected domestic appliances. For instance, the dishwashing appliance may transmit a monitoring request to the one or more connected domestic appliances. Once the monitoring request is received by the connected domestic appliances, each domestic appliance may be directed to capture or transmit images (e.g., for a set period of time as part of a new image capture sequence) to the remote server or dishwashing appliance. The subsequently captured images may be transmitted as or as part of a monitoring signal.

At 650, the method 600 includes evaluating received images for user actions. For instance, image processing (e.g., as described above) may be applied to the received images to distinguish if a user is present and generally interacting with the dishwashing appliance. In no user action is detected, the method 600 may return to 620 (e.g., to maintain the clean load indication). By contrast, if a user action is detected, the method 600 may proceed to 660.

At 660, the method 600 includes analyzing detected actions (e.g., images thereof) for a removal action. For instance, further image processing (e.g., as described above) may be applied to the received images in which a user is present to determine if the user action is a removal action. As described above, a removal action may be distinguished, for instance, by a discrete instance of a user bending over, extending an arm, or depositing an article within the wash chamber or rack assembly. In a removal action is not detected (e.g., an new insertion action is detected), the method 600 may proceed to 665. By contrast, if a removal action is detected, the method 600 may proceed to 670. Optionally, a removal count may be updated such that the total number of removal actions is measured or counted.

At 665, the method 600 includes initiating an improper loading indication in response to a "NO" determination at 660. For instance, 665 may include initiating an improper loading indication at the user interface. The improper loading indication may include, for instance, an illuminated icon (e.g., rapid sequence), projection, image, or displayed text on the door or control panel of the dishwashing appliance. Additionally or alternatively, an audible notification may be generated at a speaker of the control panel. Further additionally or alternatively, the clean load indication may include an image or displayed text on the remote device, or any other suitable arrangement for visually or audibly notifying a user that articles have been improperly loaded into the dishwasher (e.g., a "dirty" article has been mixed with articles within the appliance that may be considered "clean").

At 670, the method 600 includes determining a load status. Specifically, it is determined whether a fully unloaded state has been reached following determination of a removal action at 660. Optionally, the removal count may be compared to a previously determined insertion count. A predetermined matching condition based on detected insertion actions may be provided for the comparison (e.g., to determine if the removal count matches an insertion count of previously detected insertion actions). In some embodiments, the matching condition includes set range (e.g., number range, function, or percentage calculated based on the detected insertion actions or insertion count) for deviations between the removal count and the insertion count. In other words, it may be determined whether the total number of removal actions is within the set range from the total number of insertion actions. Optionally, the set range may be less than or equal to 10% of the insertion count. If a fully unloaded state has not been reached, the method 600 may return to 620 (e.g., to maintain the clean load indication). By contrast, if a fully unloaded state has been reached, the method 600 may proceed to 675, wherein the clean load indication may be halted (e.g., such that the illuminated icon, projection, image, or displayed text on the user interface is stopped).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance comprising:

detecting one or more insertion actions for a loading one or more articles into the dishwashing appliance;

directing, subsequent to the detected insertion actions, a dishwasher cycle within the dishwashing appliance;

detecting, subsequent to the dishwasher cycle, one or more removal actions for unloading the one or more articles from the dishwashing appliance;

evaluating the detected removal actions against the detected insertion actions; and directing a user interface of the dishwashing appliance based on the evaluation;

transmitting, prior to detecting one or more removal actions and subsequent to the dishwasher cycle, a monitoring request to one or more connected domestic appliances spaced apart from the dishwashing appliance; and receiving a monitoring signal from the one or more connected domestic appliances in response to transmitting the monitoring request, wherein detecting one or more removal actions is based on the received monitoring signal, wherein detecting one or more insertion actions comprises receiving a captured image from a camera assembly in operable communication with the dishwashing appliance, wherein the camera assembly is fixed to a corresponding domestic appliance of the one or more connected domestic appliances spaced apart from the dishwashing appliance, and wherein the camera assembly is directed away from the corresponding domestic appliance.

2. The method of claim 1, further comprising detecting a door-open event subsequent to the dishwasher cycle, wherein detecting one or more removal actions is partially conditioned on detecting the door-open event.

3. The method of claim 1, wherein detecting one or more insertion actions comprises analyzing the captured image according to a trained AI model.

4. The method of claim 1, further comprising initiating a clean load indication at the user interface subsequent to the dishwasher cycle;

wherein evaluating comprises determining the detected removal actions meets a predetermined matching condition based on the detected insertion actions, and wherein directing the user interface comprises halting the clean load indication in response to determining the detected removal actions meets the predetermined matching condition.

5. The method of claim 1, further comprising initiating a clean load indication at the user interface subsequent to the dishwasher cycle;

wherein evaluating comprises determining the detected removal actions fails a predetermined matching condition based on the detected insertion actions, and wherein directing the user interface comprises maintaining the clean load indication in response to determining the detected removal actions fails the predetermined matching condition.

6. The method of claim 1, wherein evaluating comprises determining the detected removal actions fails a predetermined matching condition based on the detected insertion actions, wherein the method further comprises detecting a new insertion action subsequent to determining the detected removal actions fails the predetermined matching condition, and wherein directing the user interface comprises initiating an improper loading indication in response to detecting the new insertion action.

7. A method of operating a dishwashing appliance comprising:

detecting, apart from the dishwashing appliance, one or more insertion actions for a loading one or more articles into the dishwashing appliance;

directing, subsequent to the detected insertion actions, a dishwasher cycle within the dishwashing appliance;

detecting, apart from the dishwashing appliance and subsequent to the dishwasher cycle, one or more removal actions for unloading the one or more articles from the dishwashing appliance;

evaluating the detected removal actions against the detected insertion actions;

determining a load status of the dishwashing appliance based on the evaluation; and directing a user interface of the dishwashing appliance based on the determined load status;

transmitting, prior to detecting one or more removal actions and subsequent to the dishwasher cycle, a monitoring request to one or more connected domestic appliances spaced apart from the dishwashing appliance; and receiving a monitoring signal from the one or more connected domestic appliances in response to transmitting the monitoring request, wherein detecting one or more removal actions is based on the received monitoring signal, wherein detecting one or more insertion actions comprises receiving a captured image from a camera assembly in operable communication with the dishwashing appliance, wherein the camera assembly is fixed to a corresponding domestic appliance of the one or more connected domestic appliances spaced apart from the dishwashing appliance, and wherein the camera assembly is directed away from the corresponding domestic appliance.

8. The method of claim 7, further comprising detecting a door-open event subsequent to the dishwasher cycle, wherein detecting one or more removal actions is partially conditioned on detecting the door-open event.

9. The method of claim 7, wherein detecting one or more insertion actions comprises analyzing the captured image according to a trained AI model.

10. The method of claim 7, further comprising initiating a clean load indication at the user interface subsequent to the dishwasher cycle;

wherein evaluating comprises determining the detected removal actions meets a predetermined matching condition based on the detected insertion actions, and wherein directing the user interface comprises halting the clean load indication in response to determining the detected removal actions meets the predetermined matching condition.

11. The method of claim 7, further comprising initiating a clean load indication at the user interface subsequent to the dishwasher cycle;

wherein evaluating comprises determining the detected removal actions fails a predetermined matching condition based on the detected insertion actions, and wherein directing the user interface comprises maintaining the clean load indication in response to determining the detected removal actions fails the predetermined matching condition.

12. The method of claim 7, wherein evaluating comprises determining the detected removal actions fails a predetermined matching condition based on the detected insertion actions, wherein the method further comprises detecting a new insertion action subsequent to determining the detected removal actions fails the predetermined matching condition, and wherein directing the user interface comprises initiating an improper loading indication in response to detecting the new insertion action.

* * * * *